US008875960B2

(12) United States Patent
Terashima et al.

(10) Patent No.: US 8,875,960 B2
(45) Date of Patent: Nov. 4, 2014

(54) TILTING-TYPE AUTOMATIC MOLTEN METAL POURING METHOD, TILTING CONTROL SYSTEM, AND STORAGE MEDIUM HAVING TILTING CONTROL PROGRAM STORED THEREIN

(75) Inventors: Kazuhiko Terashima, Toyohashi (JP); Yoshiyuki Noda, Toyohashi (JP); Makio Suzuki, Toyokawa (JP); Hiroyasu Makino, Toyokawa (JP); Kazuhiro Ota, Toyokawa (JP)

(73) Assignees: Sintokogio, Ltd., Nagoya-Shi (JP); National University Corporation Toyohashi University of Technology, Toyohashi-Shi (JP)

( * ) Notice: Subject to any disclaimer, the term of this patent is extended or adjusted under 35 U.S.C. 154(b) by 525 days.

(21) Appl. No.: 13/266,756

(22) PCT Filed: Mar. 31, 2010

(86) PCT No.: PCT/JP2010/055918

§ 371 (c)(1),
(2), (4) Date: Jan. 13, 2012

(87) PCT Pub. No.: WO2010/125890

PCT Pub. Date: Nov. 4, 2010

(65) Prior Publication Data

US 2012/0109354 A1 May 3, 2012

(30) Foreign Application Priority Data

Apr. 28, 2009 (JP) ..... 2009-108601

(51) Int. Cl.

| | |
|---|---|
| ***G06F 17/00*** | (2006.01) |
| ***B22D 41/04*** | (2006.01) |
| ***B22D 41/06*** | (2006.01) |
| ***B22D 39/04*** | (2006.01) |
| ***B22D 37/00*** | (2006.01) |

(52) U.S. Cl.

CPC ..... *B22D 39/04* (2013.01); *B22D 41/06* (2013.01); *B22D 37/00* (2013.01)

USPC ..... 222/604; 700/146; 266/240; 164/335

(58) Field of Classification Search

USPC ..... 700/108, 146, 147; 266/44, 45, 96, 236, 266/240; 164/135, 136, 335, 336; 222/590, 222/591, 604

See application file for complete search history.

(56) References Cited

U.S. PATENT DOCUMENTS

| | | | | |
|---|---|---|---|---|
| 8,202,472 | B2 * | 6/2012 | Noda et al. | 266/45 |
| 8,327,912 | B2 * | 12/2012 | Terada et al. | 164/136 |
| 2007/0023160 | A1 * | 2/2007 | Lauper | 164/337 |
| 2008/0196856 | A1 * | 8/2008 | Terada et al. | 164/136 |

FOREIGN PATENT DOCUMENTS

| | | | |
|---|---|---|---|
| EP | 2 140 955 | A1 | 1/2010 |
| JP | 9-10924 | | 1/1997 |
| JP | 10-58120 | | 3/1998 |
| JP | 2005-88041 | | 4/2005 |
| JP | 2008-290148 | | 12/2008 |
| WO | WO 2008/136202 | A1 | 11/2008 |
| WO | WO 2008136227 | A1 * | 11/2008 |

OTHER PUBLICATIONS

International Search Report dated Apr. 27, 2010 issued in International Application No. PCT/JP2010/055918.

* cited by examiner

*Primary Examiner* — Charles Kasenge
(74) *Attorney, Agent, or Firm* — Finnegan, Henderson, Farabow, Garrett & Dunner, L.L.P.

(57) ABSTRACT

A method of automatically pouring molten metal from a ladle into a mold by tilting the ladle. In the method, the height of molten metal located above a molten metal outlet and the weight of molten metal flowing out of the ladle are estimated using an expanded Kalman filter on the basis of: the weight of the molten metal flowing out of the ladle, said weight being measured using a load cell; the voltage inputted to a servo motor; the angle of tilt of the ladle measured by a rotary encoder; and the position of the ladle in the lifting and lowering direction thereof. The sum of the weight of the molten metal flowing out of the ladle when the ladle is tilted rearward, said weight being estimated from the angle of tilt of the ladle and the height of the molten metal located above the molten metal outlet estimated by the expanded Kalman filter, and the weight of the molten metal flowing out of the ladle estimated by the expanded Kalman filter are estimated as the final weight of outflowing molten metal. The estimated final weight of outflowing molten metal is determined whether or not to be greater than or equal to a specific weight of outflow, and the operation of rearward tilting of the ladle is started on the basis of the result of the determination.

6 Claims, 8 Drawing Sheets

TILTING-TYPE AUTOMATIC MOLTEN METAL POURING METHOD, TILTING CONTROL SYSTEM, AND STORAGE MEDIUM HAVING TILTING CONTROL PROGRAM STORED THEREIN

TECHNICAL FIELD

This invention relates to a tilting-ladle-type automatic pouring method for automatically pouring molten metal from a ladle into a mold by tilting the ladle that holds the molten metal therein, a system for controlling the tilting motion of the ladle, and a storing medium that stores a control program for controlling the system. In particular, this invention relates to a ladle-tilting basis automatic pouring method using a servo motor that is controlled by means of a computer that is pre-configured to contain a program that causes the computer to execute a pouring process such that the servo motor positively tilts a ladle that has a tapping hole with a given shape for pouring molten metal and then inversely tilts the ladle to pour the molten metal therefrom into a mold, a tilting control system for controlling the tilting motion of the ladle, and a storing medium that stores a tilting control program for controlling the tilting motion of the ladle.

BACKGROUND OF THE INVENTION

Conventionally, typical tilting-ladle-type automatic pouring methods are known as disclosed in Patent Literature 1, 2, and 3.

In the method in Patent Literature 1, a ladle is inversely tilted when it pours molten metal at an arbitrary rate of pouring. Then, a predicted volume of the molten metal poured until draining is derived based on the volume of the molten metal poured during the inverse tilting step, while the rate of pouring is derived. The predicted volume of the molten metal poured until draining when the pouring begins at the derived rate of pouring is sequentially compared with the remaining volume of pouring, which denotes the difference between the target volume of the molten metal poured and the current volume of the molten metal poured. The ladle is then inversely tilted when the remaining volume is less than the predicted volume of the molten metal poured until draining to complete pouring.

The method of Patent Literature 2 uses a servo motor that is controlled by means of a computer that is preconfigured to contain a program. In this method, a ladle holding molten metal is tilted to a side of a bank of the ladle to rapidly raise the molten-metal level to a target level to begin pouring the molten metal under conditions to prevent the molten metal from overflowing from the bank. The ladle is continuously tilted to the side of the bank to eject the molten metal therein such that the outflowed volume of the molten metal from the ladle substantially equals the inflow volume of the molten metal into a mold, when the pouring begins and at the end of the startup, while the molten-metal level in the bank is maintained at a substantially constant level. The ladle is then tilted to the opposite side of the bank to prevent the molten metal in the ladle from sloshing while the molten metal is drained to complete pouring.

In the method of Patent Literature 3, a molten metal level in a ladle when it is reversely tilted is derived based on a molten metal level that is located above the tapping hole of the ladle and lowers by stopping the forward tilting of the ladle and a molten-metal level that lowers by beginning the reverse tilting of the ladle. Using (1) a relationship between the derived molten-metal level and the filling weight of the molten metal poured into a mold from the ladle and (2) a model of the flow rate of the molten metal poured for the filling weight of the molten metal that flows from the ladle into the mold, the final filling weight of the molten metal poured from the forward tilting of the ladle to the reverse tilting of the ladle is predicted by assuming that the final filling weight is the sum of the filling weight of the molten metal poured when the ladle begins the inverse tilting and the filling weight of the molten metal poured after the ladle begins the inverse tilting. Then, a determination is made whether the predicted final filling weight of the molten metal poured equals a predetermined final filling weight. Based on the result of the determination, the reverse tilting motion of the ladle begins.

PRIOR ART LITERATURE

Patent Literature

Patent Literature 1: Japanese Patent Laid-open Publication No. 10-58120

Patent Literature 2: Japanese Patent Laid-open Publication No. 2005-88041

Patent Literature 3: WO2008/136202

The disclosures in the above literature are incorporated herein by reference.

SUMMARY OF THE INVENTION

The Problem to be Solved by the Invention

Constructing a system for embodying the pouring method in Patent Literature 1, however, requires a number of basic experiments and a time-consuming approach. Further, in high-speed pouring, because an error between the predicted weight of the outflow molten metal based on an experimental basis and the actual weight of the outflow molten metal tends to increase, the reverse tilting motion of the ladle should be carried out in several batches. Besides, because a back action when the forward tilting motion of the ladle is stopped negatively affects a load cell, a waiting time of several seconds should be required after the tilting motion of the ladle is stopped. Thus, the inverse tilting motion of the ladle requires a prolonged time. Further, Patent Literature 1 does not take into consideration the effect of variations in flow of the molten metal, which depends on the tilting angle of the ladle such that certain tilting angles of the ladle may encounter a problem in which the accuracy of the weight of the outflow molten metal is degraded.

In the method in Patent Literature 3, the shape of the ladle should be limited to a fan shape. Further, this method uses equations based on a repeat operation to conduce a problem in which the computation load on the basis of actual time in a controller is increased.

In addition, the pouring methods in Patent Literature 1, 2, and 3 involve a problem in which the accuracy of the measured weight of the outflow molten metal is significantly affected by a responsive property of a load cell for measuring the weight of the discharged molten metal and measurement noise.

The present invention that is made in view of the foregoing situations aims to provide a tilting-type automatic pouring method and a tilting control system for controlling the tilting motion of a ladle enabling both high-speed and high accuracy pouring for tilting the ladle holding molten metal therein to pour it into a mold. The present invention also aims to provide a storing medium that stores a control program for controlling the tilting motion of the ladle.

Means to Achieve the Object

To achieve the object, the invention of claim 1 features a method for tilting-type automatic pouring molten metal from a ladle to a mold, wherein the ladle has a tapping hole with a predetermined shape and holds the molten metal, by tilting the ladle by means of a servo motor under a control of a computer in which a program to execute a pouring process is pre-configured. The method comprises the steps of:

measuring outflow weight of the molten metal that outflows from the ladle;

measuring a tilting angle that the ladle tilts and a moving position of the ladle along a direction of vertical motions of the ladle;

estimating the height level of the molten metal above the tapping hole of the ladle and the outflow weight of the molten metal that outflows from the ladle, using an extended Kalman filter, based on the measured outflow weight of the molten metal that outflows from the ladle, the measured tilting angle that the ladle tilts, the measured position of the ladle along a direction of vertical motions of the ladle, and an input voltage to the servo motor;

predicting the final outflow weight of the molten metal as the sum of a predicted outflow weight of the molten metal that outflows from the ladle when the ladle inversely tilts, which is predicted based on the tilting angle of the ladle and the estimated height level of the molten metal above the tapping hole of the ladle that has been estimated by the extended Kalman filter, and the estimated outflow weight of the molten metal that outflows from the ladle and that has been estimated by the extended Kalman filter; and determining if the predicted final outflow weight of the molten metal is at least a specified outflow weight, and beginning an inverse tilting motion of the ladle based on the determined result.

With the present invention, the weight of the outflow molten metal can be accurately predicted even though it is significantly affected by a responsive delay of a load cell for measuring the weight of the outflow molten metal and the measurement noise. When the predicted weight of the outflow molten metal equals, or is more than, a predetermined weight of the outflow molten metal a reverse tilting motion of the ladle begins such that the weight of the outflow molten metal can be poured to rapidly and accurately achieve the predetermined weight of the outflow molten metal.

EMBODIMENTS TO CARRY OUT THE INVENTION

Figure 1:
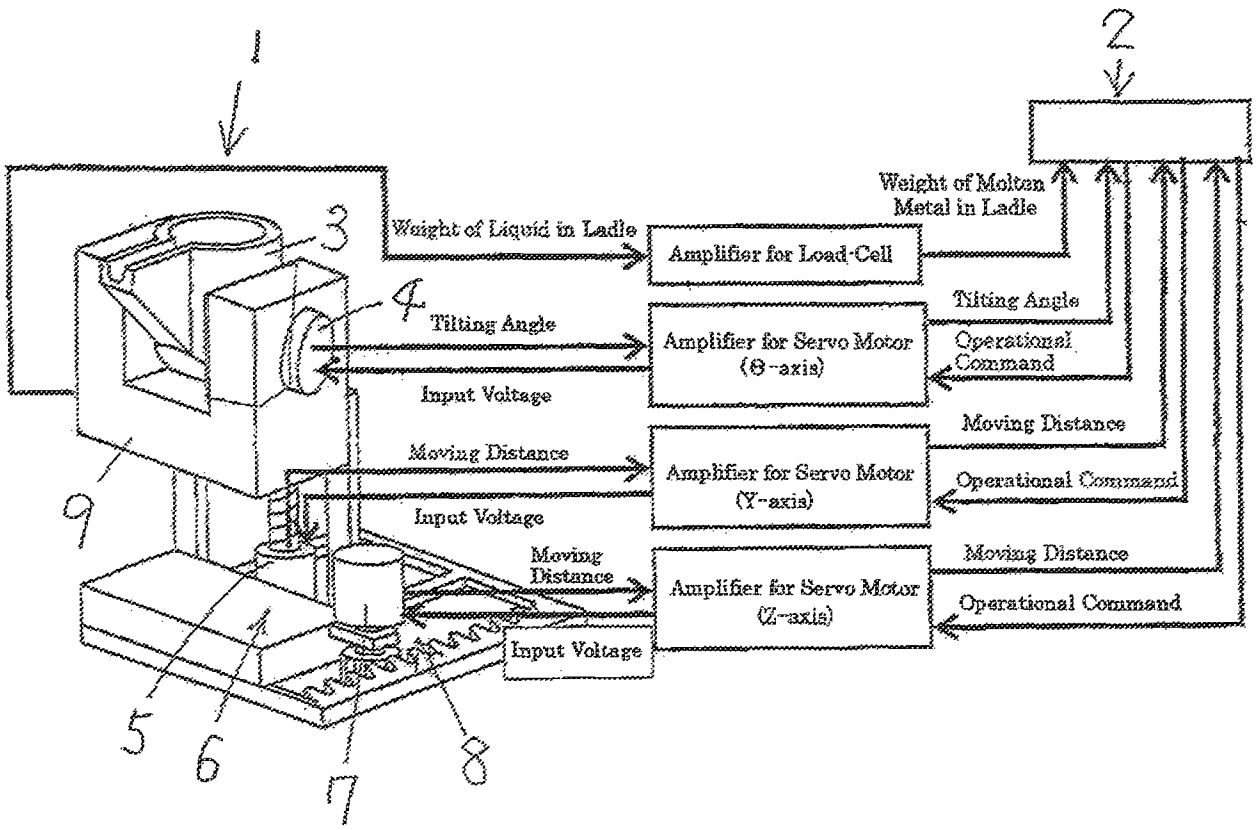
FIG. 1 is a schematic view of one embodiment of a tilting-ladle-type automatic pouring machine on which the method of the present invention is applied.

Below one embodiment of a tilting-ladle-type automatic pouring machine on which the method of the present invention is applied will be described in detail based on the accompanied drawings. As illustrated in FIG. 1, the tilting-ladle-type automatic pouring machine primarily comprises a pouring machine 1 and a controller 2 for sending commanded drive signals to the pouring machine 1. The pouring machine 1 includes a cylindrical ladle 3 having a rectangular tapping hole, a first servo motor 4 for tilting the ladle 3, an elevation mechanism 6, which includes a second servo motor 5 and a ball-screw mechanism for converting a rotational motion of an output shaft of the second servo motor 5 into a linear motion, for vertically moving the ladle 3, a horizontal moving mechanism 8, which includes a third servo motor 7 and a rack and pinion mechanism for converting a rotational motion of an output shaft of the third servo motor 7 into a linear motion, for horizontally moving the ladle 3, and a load cell 9 for measuring the weight of molten metal in the ladle 3.

The load cell 9 is coupled to a load cell amplifier (not shown). Each of the tilting angle of the ladle 3 and the position of the ladle 3 in its vertical moving direction is measured by means of a corresponding rotary encoder (not shown), each provided with the first servo motor 4 and the second servo motor 5.

The controller 2 comprises of a computer that contains a program. This program causes the computer to function as the following:

a storage means for storing a model of a flow rate of the molten metal poured that flows into a mold from the ladle 3;

a controlling means for controlling for forward and rearward movement and vertically movement of the ladle 3 in synchronization with a tilting motion of the ladle 3 such that a tapping hole of the ladle 3 is centered in the tilting motion;

an angular-deriving means for deriving a tilting angle of the ladle 3 to begin the flow of the molten metal from the ladle 3 by converting the weight of the molten metal in the ladle 3 that has been measured by means of the load cell 9 before the pouring process;

an estimating means for estimating the weight of the molten metal that flows from the ladle 3 and a level of the molten metal located above a tapping hole of the ladle 3 by calculations using an extended Kalman filter based on the weight of the molten metal that flows from the ladle 3 measured by the load cell 9, input voltages to the first servo motor 4 and the second servo motor 5, the angle that the ladle 3 tilts which is measured by the corresponding rotary encoder, and the height level of the ladle 3 in its vertical motion that is measured by the corresponding rotary encoder;

a first weight-calculating means for calculating the weight of the molten metal that flows from the ladle 3 after beginning the inverse tilting motion of the ladle 3;

a second weight-calculating means for converting the weight of the molten metal within the ladle 3 measured by the load cell 9 to the weight of the molten metal that flows from the ladle 3 into a mold;

a third weight-calculating means for calculating the final weight of the molten metal that flows from the ladle 3 during the period of time between forwardly tilting the ladle 3 and inversely tilting the ladle 3 as a sum of the weight of the molten metal that flows from the ladle 3 at the beginning of inversely tilting of the ladle and the weight of the molten metal flowed from the ladle 3 after inversely tilting of the ladle; and a determination means for determining if the calculated final weight of the molten metal flowed from the ladle 3 is a predetermined weight of the molten metal flowed from the ladle 3 or more.

Figure 2:
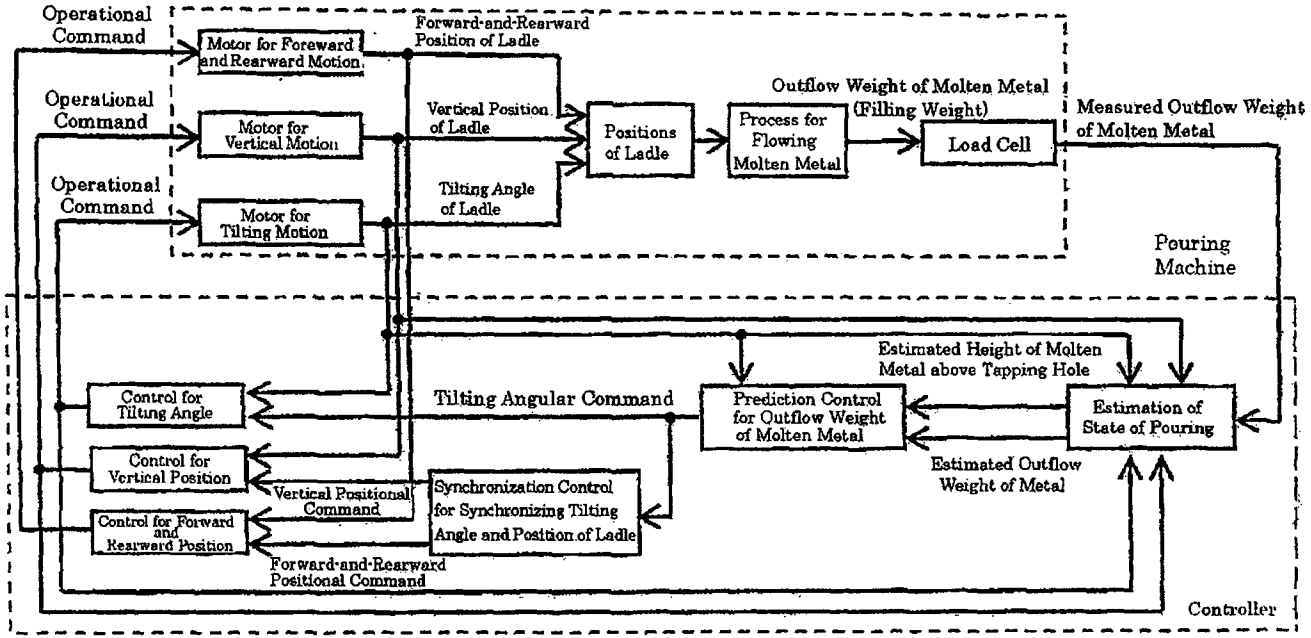
FIG. 2 is a schematic block diagram of one embodiment of a system of the present invention for controlling the tilting-ladle-type automatic pouring machine in FIG. 1.

Therefore, the controller 2 constitutes a positional and angular control system for controlling the position and an angle of the ladle to achieve accurate positioning in response to a positional controlling command and an angular controlling command, a synchronization control system for synchronizing the tilting angle that the ladle 3 tilts and the position of the ladle 3 to fix the center of the tilting motion of the ladle 3 on the tip end of the tapping hole, the weight-prediction control system for predicting the weight of the discharged molten metal that flows from the ladle 3 to carry out a high-speed and high-accuracy pouring, and an estimation system for estimating an operational state of pouring based on instrument data (see FIG. 2).

Figure 3:
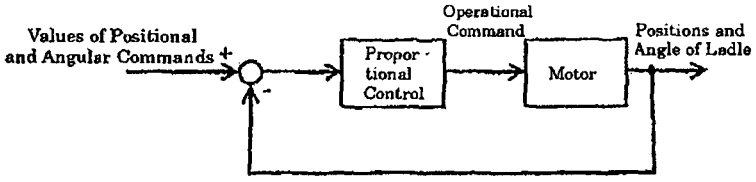
FIG. 3 is a schematic block diagram of a position/angle feedback control system based on a proportional control for a motor for forward and rearward moving of a ladle, a motor for vertically moving the ladle, and a motor for tilting the ladle.

As illustrated in FIG. 3, the positional and angular control system constitutes a proportional control system to the third servo motor 7 for forward and rearward movement of the ladle 3, the second servo motor 5 for vertically moving the ladle 3, and the first servo motor 4 for tilting the ladle 3, thereby to accurately control the position and the angle of the ladle 3.

Figure 4:
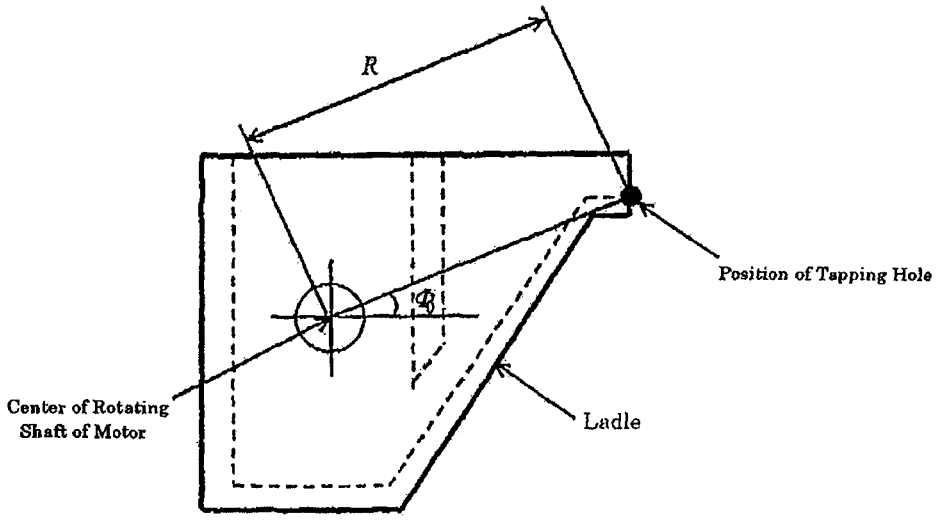
FIG. 4 is a schematic view illustrating the positional relationship between a position of the tapping hole of the ladle and the center position of a rotating shaft of a first servo motor.

In the synchronization control system, as illustrated in FIG. 4, the first servo motor 4 for tilting the ladle 3 is mounted near the center of gravity of the ladle 3 to provide load reduction. When the first servo motor 4 is actuated to tilt the ladle 3 to move the location of the tapping hole the drop position of the molten metal that flows from the ladle 3 is thus moved. For the dropped molten metal to accurately flow into the sprue of the mold, this synchronization control system is configured such that the location of the tapping hole of the ladle 3 is fixed by carrying out the vertical motion and the forward and rearward motion of the ladle 3 synchronized with the tilting motion of the ladle 3.

In FIG. 4, R denotes the linear distance between the location of the tapping hole of the ladle and the center of the rotating shaft of the first servo motor 4. $q_0$ denotes the angle between the line joining the location of the tapping hole and the center of the rotating shaft of the first servo motor 4 and the horizontal line.

With them, positional synchronization control of the ladle 3 can be expressed by Equations (1) and (2).

$$r_y = R\cos\theta_0 - R\cos(\theta_0 - r_t) \tag{1}$$

$$r_z = R\sin\theta_0 - R\sin(\theta_0 - r_t) \tag{2}$$

where $r_t$ is a tilting-angular command of a tilting angle that the ladle 3 tilts, $r_y$ is a forward-and-rearward positional command of a position of the ladle 3 in the forward and rearward direction, and $r_z$ is a vertical-positional command of a vertical position of the ladle 3 in the vertical direction. As illustrated in FIG. 2, the tilting-angular command is provided to the positional and angular synchronization control system to operate Equations (1) and (2) to generate the forward-and-rearward positional command $r_y$ and the vertical positional command $r_z$. These positional commands $r_y$ and $r_z$ both are generated by the synchronization control and are provided to the positional and angular control system to move the ladle 3 forward and rearward and vertically, and thereby to fix the position of the tapping hole such that the ladle 3 tilts around the centered tapping hole.

The weight-prediction control system for predicting the weight of the outflow molten metal is a control scheme to predict the weight of the outflow molten metal that flows from the ladle 3 when the molten metal drains so as to determine the timing of beginning the inversely tilting motion of the ladle 3 to drain the molten metal such that the predicted weight of the outflow molten metal matches the predetermined weight of the outflow molten metal. Below the weight-prediction control system will be described.

Figure 5:
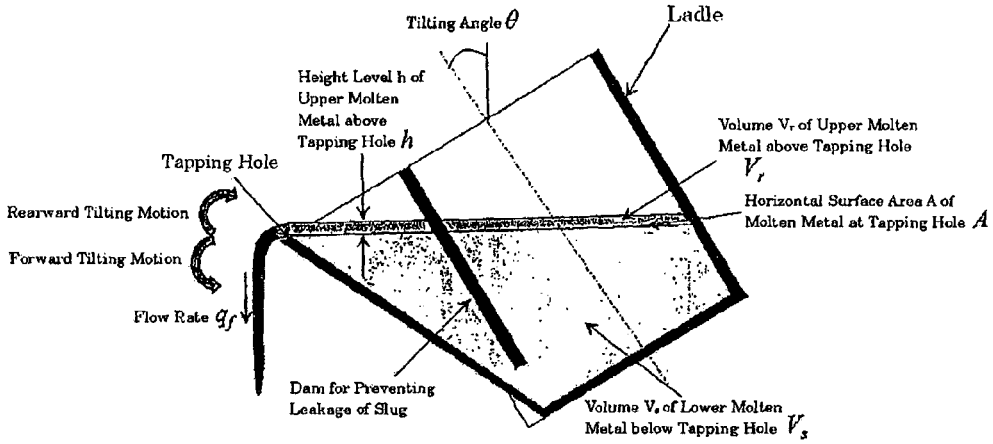
FIG. 5 is a schematic view denoting parameters in a pouring process.

First a outflow model of the molten metal is expressed by Equations (3), (4), and (5).

$$\frac{dV_r(t)}{dt} = -q_f(t) - \frac{\partial V_s(\theta(t))}{\partial\theta(t)}\omega(t) \tag{3}$$

$$h(t) = \frac{V_r(t)}{A(\theta(t))} \tag{4}$$

$$q_f(t) = c\sqrt{2g}\int_0^{h(t-L_p)} L_f(h_b)\sqrt{h_b}\,dh_b, \quad (q_f \geq 0,\ 0 < c \leq 1) \tag{5}$$

where $V_r$, $V_s$, A, h, $q_f$ and q denote, as illustrated in FIG. 5, the volume of an upper molten metal above the tapping hole of the ladle 3, the volume of a lower molten metal below the tapping hole of the ladle 3, the surface area of the molten metal, the height level of the upper molten metal, the volume of the outflow molten metal, and the tilting angle that the ladle 3 tilts, respectively.

Figure 6:
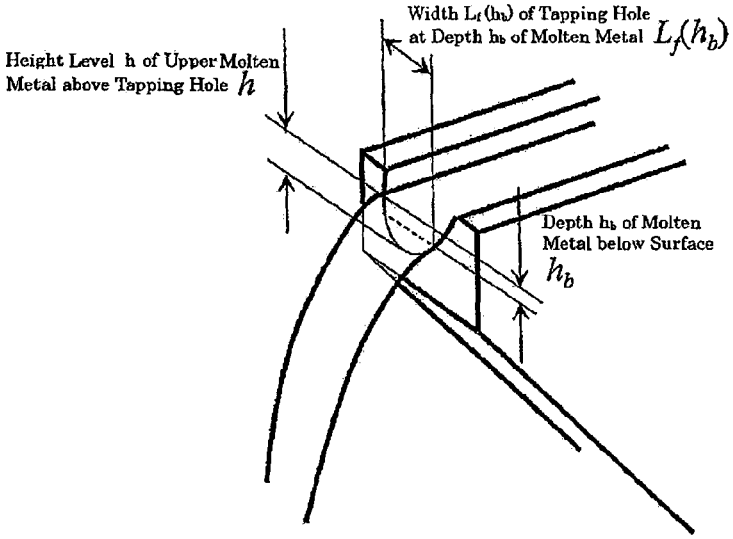
FIG. 6 is a schematic view denoting parameters in relation to the tapping hole of the ladle.

Further, $h_b$ and $L_f$ denote, as illustrated in FIG. 6, the depth of the molten metal below the surface thereof within the ladle 3 and the width of the tapping hole at depth $h_b$ of the molten metal. In addition, w denotes the tilting-angular velocity of the ladle 3, g denotes the acceleration of gravity, and c denotes a flow rate coefficient. $L_p$ denotes a delay in response of the molten metal to be discharged from the ladle 3 due to, e.g., surface tension effect. The volume $q_f$ of the outflow molten metal takes a positive value, and the flow rate coefficient c takes a value between 0 and 1. A flow rate coefficient c of 1 indicates that the molten metal is an ideal fluid.

The outflow model of the molten metal described herein adds the dead time $L_p$, which denotes the delay in response of the molten metal to flow from the ladle 3 due to surface tension effect, to the outflow model of the molten metal described in Patent Literature 3 (WO 2008/136202).

In the present outflow model of the molten metal, by substituting Equation (3) into Equation (4), Equation (6) can be obtained as follows:

$$\frac{dh(t)}{dt} = -\frac{q_f(h(t-L_p))}{A(\theta(t))} - \frac{h(t)}{A(\theta(t))}\frac{\partial A(\theta(t))}{\partial \theta(t)}\omega(t) - \frac{1}{A(\theta(t))}\frac{\partial V_s(\theta(t))}{\partial \theta(t)}\omega(t) \quad (6)$$

As expressed following Equation (7), by temporally integrating the volume $q_f$ of the outflow molten metal, the weight W of the outflow molten metal that flows from the ladle 3 can be obtained.

$$W = \rho \int_{t_0}^{t_1} q_f(t-L_p)dt = \rho c\sqrt{2g}\int_{t_0}^{t_1}\int_0^{h(t-L_p)} L_f(h_b)\sqrt{h_b}\,dh_b dt \quad (7)$$

where r denotes the density of the molten metal and the time from $t_0$ to $t_1$ is the time required for acquiring the weight of the outflow molten metal that flows from the ladle 3.

Using the pouring model expressed by Equations (7) and (8), the weight-prediction control system for predicting the weight of the outflow molten metal is configured. This control system is conditional on whether the pattern of the inverse tilting of the ladle 3 when the molten metal drains (a time history of the tilting-angular velocity of the ladle 3) is a uniquely-predetermined pattern. This condition is the common condition in the art of sequence control and feed forward control.

As expressed in Equation (7), the volume of the outflow molten metal includes the dead time $L_p$. This indicates that the volume of the outflow molten metal may be affected by the influence during the tilting motion of the ladle 3 when it is temporally suspended even at time $t_s$ at which draining of the molten metal begins. Therefore, as expressed in Equation (8), the volume of the outflow molten metal is divided as the volume of $q_f(h(t))$ of the outflow molten metal at time t and a variation $Dq_f$ in the volume of the outflow molten metal in the dead time.

$$q_f(h(t-\tau)) = q_f(h(t)) + \Delta q_f, (\Delta q_f = q_f(h(t-\tau)) - q_f(h(t)), 0<\tau\leq L_p) \quad (8)$$

Presuming that the variation in the volume of the outflow molten metal during dead time at time $t_s$ at which draining of the molten metal begins is minimal compared to the volume of the outflow molten metal at time $t_s$ as ($q_f(n(ts))$>>Dqf), Equation (8) can be rewritten as follows:

$$q_f(h(t-\tau)) \approx q_f(h(t_s)), 0<\tau\leq L_p \quad (9)$$

Because, in Equation (7), the density r of the molten metal, the flow rate coefficient c, and the acceleration of gravity g are constant and the width $L_f$ of the tapping hole can be determined based on the shape of the tapping hole, the volume $q_f$ of the outflow molten metal depends on the height level h of the upper molten metal at the tapping hole. Thus, the weight W of the volume of the outflow molten metal can be derived by temporally integrating the volume of the outflow molten metal. Therefore, the weight $W_b$ of the volume of the outflow molten metal that flows from the ladle 3 during the operation of draining the molten metal can be expressed as following Equation (10):

$$W_b = \int_{t_s}^{t_f} f_q(h(t-L_p))dt \quad (10)$$

where $f_q$ is a representation function to represent using Expression (5) from the height level h of the upper molten metal above the tapping hole to the space of the volume $q_f$ of the outflow molten metal. Further, ts is the time at which draining the molten metal begins and tf is the time at which pouring the molten metal is completed. Substituting the assumption in Equation (9) into Equation (10) provides Equation (11).

$$W_b = \int_{t_s}^{t_f} f_q(h(t-L_p))dt \approx \int_{t_s}^{t_f} f_q(h(t))dt + \int_0^{L_p} f_q(h(t_s))d\tau \quad (11)$$

Based on the condition in which the pattern of the inverse tilting motion of the ladle 3 is the predetermined pattern, the tilting-angular velocity w of the ladle 3 is uniquely defined. Then, from Equation (9), the tilting angle $q_b(t)$ that the ladle 3 tilts when the molten metal drains depends on the tilting angle $q_s$ that the ladle 3 tilts when draining the molten metal begins.

$$\theta_b(t) = \int_{t_s}^{t} \omega\, d\tau + \theta_s \quad (12)$$

In Equation (6), both the surface area A of the molten metal in the ladle 3 and the volume $V_s$ of the lower molten metal below the tapping hole depends on the tilting angle that the ladle 3 tilts, while $q_f$ depends on the height level h of the upper molten metal above the tapping hole of the ladle 3. Further, the assumption in Equation (9) is considered. Therefore, because equation (12) and the tilting-angular velocity w of the ladle 3 is uniquely defined, the height level $h_b$ of the upper molten metal above the tapping hole of the ladle 3 when the molten metal drains is determined, as expressed by equation (13), by the height level $h_s$ of the upper molten metal above the tapping hole of the ladle 3 when draining of the molten metal begins and the tilting angle $q_s$ that the ladle 3 tilts.

$$h_b(t) = f_h(\theta_s, h_s) \quad (13)$$

where $f_h$ is a representation function to represent using Equation (6) from the height level $h_s$ of the upper molten metal above the tapping hole when draining the molten metal begins and the tilting angle $q_s$ that the ladle 3 tilts to the space of the height level hb of the upper molten metal above the tapping hole of the ladle 3 when the molten metal drains. By substituting Equation (13) into Equation (11), Equation (14) is obtained.

$$W_b \approx \int_{ts}^{tf} f_q(f_h(\theta_s, h_s))dt + \int_0^{L_p} f_q(h_s)d\tau \quad (14)$$

From Equation (14), it is understood that the weight $W_b$ of the outflow molten metal that flows from the ladle 3 when the molten metal drains depends on the tilting angle $q_s$ that the ladle 3 tilts when draining of the molten metal begins and the height level $h_s$ of the upper molten metal above the tapping hole of the ladle 3. For this reason, the weight of the outflow molten metal that flows from the ladle 3 when the molten metal drains can be predicted by acquiring the tilting angle of the ladle 3 and the height level of the upper molten metal when the molten metal drains.

Configuring the weight-prediction control system, which is based on the predicted weight of the outflow molten metal that flows from the ladle 3, requires real-time processing of Equation (14). However, such a real-time processing is difficult because Equation (14) requires derivation of the differential equation expressed in Equation (6), using the boundary conditions, i.e., the tilting angle $q_s$ of the ladle 3 and the height level $h_s$ of the upper molten metal. Therefore, a multi-term approximation is introduced to Equation (14) to allow real-time processing. Equation (15) expresses the polynominal approximation of the weight $W_{bq}$ of the outflow molten metal with the tilting angle $q_s$ that the ladle 3 tilts when draining of the molten metal begins is fixed, while the height level $h_s$ of the upper molten metal above the tapping hole of the ladle 3 is varied.

$$W_{b\theta}(h_s) \approx \sum_{i=0}^{k} a_i h_s^i \tag{15}$$

Then, a plurality of tilting angles $q_s$ are obtained by varying the tilting angle $q_s$ that the ladle 3 tilts when draining of the molten metal begins such that the respective tilting angles $q_s$ are multi-term approximated by Equation (15). In turn, the obtained coefficients $a_i$ are multi-term approximated as shown by Equation (16).

$$a_i(\theta_s) \approx \sum_{j=0}^{l} b_{ij}\theta_s^j \tag{16}$$

Equation (17) is provided by substituting Equation (16) for Equation (15).

$$W_b(\theta_s, h_s) \approx \sum_{i=0}^{k} \sum_{j=0}^{l} b_{ij}\theta_s^j h_s^i \tag{17}$$

Based on Equation (17) which is a polynomial equation, the weight $W_b$ of the outflow molten metal that flows from the ladle 3 when draining of the molten metal begins can be predicted with a real-time processing.

The operation for draining the molten metal begins when the weight W of the outflow molten metal that is flowed from the ladle 3 during pouring and the weight $W_b$ of the outflow molten metal that flows from the ladle 3 when the molten metal drains comply with the condition expressed by Equation (18).

$$W+W_b \geq W_{tg} \tag{18}$$

Figure 7:
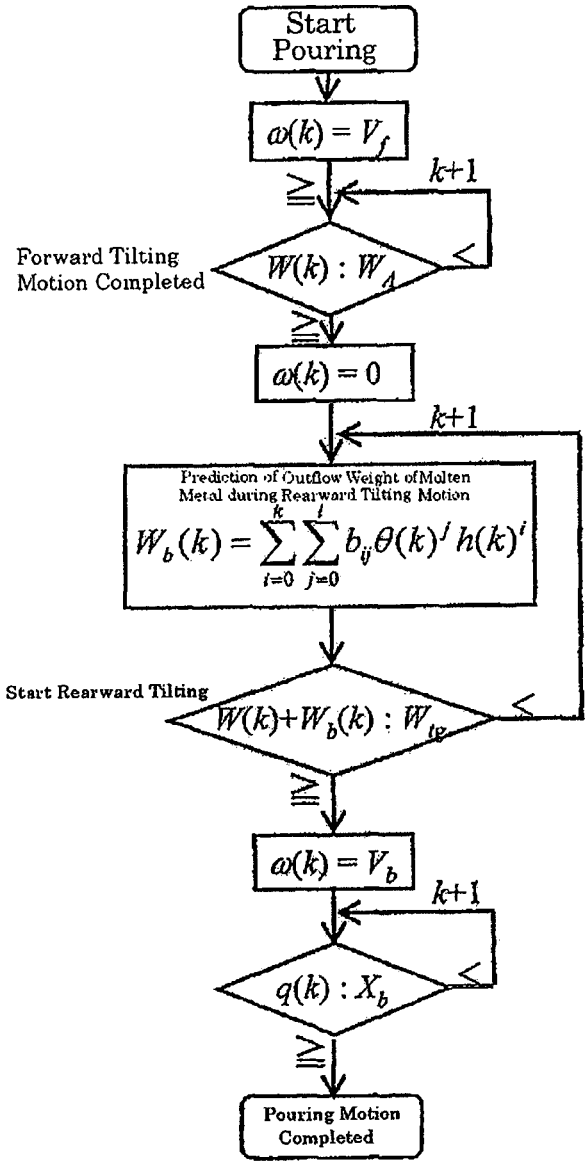
FIG. 7 is a flowchart of prediction control for a outflow weight of the molten metal poured.

The flow chart of the weight-prediction control system is shown in FIG. 7. In the control system in FIG. 7, first the ladle 3 begins the forward tiling movement. Upon the ladle 3 achieving the tilting angle at which discharging of the molten metal begins, the molten metal in the ladle 3 outflows therefrom. Upon the weight of the outflow molten metal achieving the determined weight $W_A$, the tilting motion of the ladle 3 is suspended. Equation (17) (i.e., the prediction of the weight of the outflow molten metal that flows from the ladle 3 when the molten metal drains) and Equation (18) (i.e., a discriminant for determining when the draining motion of the molten metal begins) are carried out such that draining the molten metal begins upon the conditions complying Equation (18). With this process, the molten metal can be poured with high accuracy to the target weight of the outflow molten metal. When Equations (17) and (18) are carried out, it is necessary that the height level h of the upper molten metal above the tapping hole of the ladle 3, the tilting angle q that the ladle 3 tilts, and the weight W of the outflow molten metal during pouring should be detected. Although the tilting angle can be measured by means of the rotary encoder, it is difficult to measure the height level h of the upper molten metal above the tapping hole of the ladle 3. Although the weight of the outflow molten metal during pouring can be measured by means of the load cell, it cannot be accurately measured due to a delay in response of the load cell and the effect of noise. Therefore, the estimation system for estimating the operational state of pouring is configured to estimate the height level h of the upper molten metal above the tapping hole of the ladle 3 and the weight W of the outflow molten metal during pouring, both represents quantities of state for the operational state of pouring.

This estimation system estimates quantities of state for the operational state of pouring that are required by the weight-prediction control system for predicting the outflow weight of the molten metal flowed from the ladle 3. By configuring the estimation system, this system estimates quantities of state for the operational state of pouring using the extended Kalman filter. To configure the estimation system, the automatic pouring process is modeled.

Figure 8:
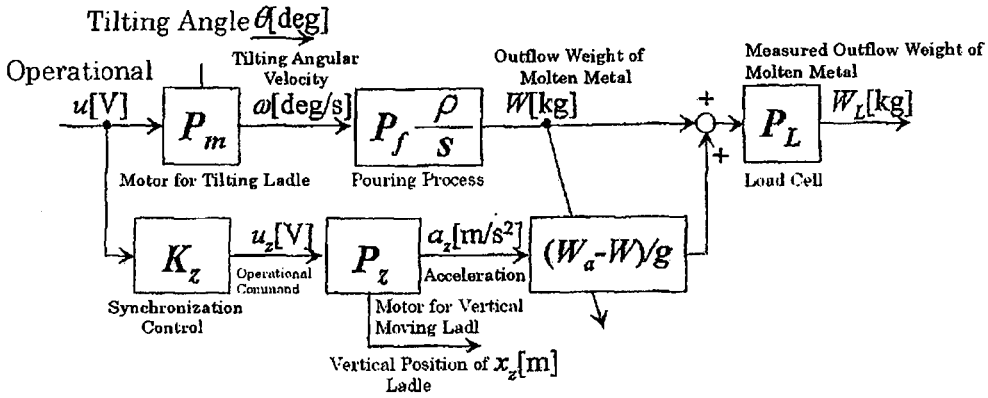
FIG. 8 is a schematic block diagram illustrating an automatic pouring process.

FIG. 8 shows the schematic diagram of the automatic pouring process. In FIG. 8, when an operational command u is provided to a motor $P_m$ for tilting the ladle 3, the ladle 3 tilts with the tilting-angular velocity w and the tilting angle q that the ladle 3 tilts. The following Equation (19) expresses a model of the motor for tilting ladle 3.

$$\frac{d\omega(t)}{dt} = -\frac{1}{T_{mt}}\omega(t) + \frac{K_{mt}}{T_{mt}}u(t) \tag{19}$$

wherein $T_{mt}$ is the time constant of the motor for tilting ladle and $K_{mt}$ is the gain constant. Tilting the ladle 3 causes the molten metal therein to outflow. As discussed below, this pouring process $P_f$ is expressed in Equations (5) and (6).

In the pouring process, dead time $L_p$ denotes the delay in response of the molten metal to flow from the ladle 3 due to, e.g., surface tension effect. To introduce the dead time into the extended Kalman filter, Pade approximations of a first-order system, as expressed in Equations (20) and (21), are used to express the dead time.

$$\frac{dq_x(t)}{dt} = -\frac{2}{L_p}q_x(t) + \frac{2}{L_p}q_f(h(t)) \tag{20}$$

$$q_e(t) = 2q_x(t) - q_f(h(t)) \tag{21}$$

where of $q_f(h(t))$ denotes the flow rate of the molten metal poured at time t, $q_x$ denotes a quantity of state by expressing the dead time with Pade approximations of the first-order system, and $q_e$ denotes the flow rate of the molten metal poured at time $t-L_q$.

In Equation (6), $q_e(t)=q_f(h(t-L_p))$ is substituted. Further, flow rate $q_f$ of the molten metal poured is temporally integrated to convert the volume to the weight such that the weight W of the outflow molten metal can be obtained as expressed in Equation (7). In Equation (7), similar to Equation (6), $q_e(t)=q_f(h(t-L_p))$ is substituted for the dead time of the flow rate of the molten metal poured. On the other hand, an operational command to be provided to the first servo motor 4 for tilting the ladle 3 is used in the synchronization control system for synchronizing the tilting angle that the ladle 3 tilts and the position of the ladle 3. The synchronization control $K_z$ is expressed by Equations (1) and (2). Then, as described below and as shown in FIG. 8, during the positional control of the ladle, an operational command $u_z$ is provided to a servo motor $P_z$ for vertically moving the ladle. Equation (22) expresses a model of the servo motor for vertically moving the ladle.

$$\frac{dv_z(t)}{dt} = a_z(t) = -\frac{1}{T_{mz}}v_z(t) + \frac{K_{mz}}{T_{mz}}u_z(t) \tag{22}$$

wherein $T_{mz}$ is the time constant of the second servo motor 5 for vertically moving the ladle and $K_{mz}$ is the gain constant. $v_z$ is the velocity of vertical movement of the ladle, and $a_z$ is the acceleration of vertical movement of the ladle.

Vertical motion of the ladle 3 is carried out by means of the synchronization control system for synchronizing the tilting angle that the ladle 3 tilts and the position of the ladle 3. This vertical motion of the ladle 3 is superimposed on data of the weight of the outflow molten metal that is measured by means of the load cell that is attached to the automatic pouring machine as shown in FIG. 1. $W_a$ denotes the initial load on a spring of the load cell 9 before the molten metal flows from the ladle 3. This load decreases as the molten metal flows from the ladle 3. g denotes the acceleration of gravity. The weight of the outflow molten metal and the vertical motion of the ladle 3 provide the measured weight $W_L$ of the molten metal through dynamic characteristics of the load cell 9. Equation (23) expresses a model of the load cell.

$$\frac{dW_L(t)}{dt} = -\frac{1}{T_L}W_L(t) + \frac{1}{T_L}\left(W(t) + \frac{W_a - W(t)}{g}a_z(t)\right) \tag{23}$$

where $T_L$ denotes the time constant of the load cell.

Using Equations (6), (7), and (19) to (23), the automatic pouring process can be expressed by an equation of state as represented by Equation (24) and an output equation can be provided as represented by Equation (25).

$$\frac{dz(t)}{dt} = f(z(t), v(t)) = \frac{d}{dt}\begin{pmatrix}\omega\\ \theta\\ h\\ q_x\\ W\\ v_z\\ x_z\\ W_L\end{pmatrix} = \begin{pmatrix} -\frac{1}{T_{mt}}\omega(t) + \frac{K_{mt}}{T_{mt}}u(t) \\ \omega(t) \\ -\frac{2q_x(t) - q_f(h(t))}{A(\theta(t))} - \frac{h(t)}{A(\theta(t))}\frac{\partial A(\theta(t))}{\partial\theta(t)}\omega(t) - \frac{1}{A(\theta(t))}\frac{\partial V_s(\theta(t))}{\partial\theta(t)}\omega(t) \\ -\frac{2}{L_p}q_x(t) + \frac{2}{L_p}q_f(h(t)) \\ 2q_x(t) - q_f(h(t)) \\ -\frac{1}{T_{mz}}v_z(t) + \frac{K_{mz}}{T_{mz}}u_z(t) \\ v_z(t) \\ -\frac{1}{T_L}W_L(t) + \frac{1}{T_L}\left(W(t) + \frac{W_a - W(t)}{g}\left(-\frac{1}{T_{mz}}v_z(t) + \frac{K_{mz}}{T_{mz}}u_z(t)\right)\right) \end{pmatrix} \tag{24}$$

$$y(t) = \xi(z(t)) = (\theta(t)\ x_z(t)\ W_L(t))^T \tag{25}$$

where input vector u(t) in Equation (24) is expressed as $u(t)=(u(t)\ u_z(t))^T$. Using the process model of the automatic pouring process expressed by Equations (24) and (25), the estimation system based on the extended Kalman filter for estimating a quantity of state of pouring is configured. First, using the Euler method, Equations (24) and (25), represented by differential equations, are converted to difference equations as represented by Equations (26) and (27).

$$z(k+1) = f(z(k), v(k)) \tag{26}$$

$$= \begin{pmatrix} \left(1 - \frac{\Delta T}{T_{mt}}\right)\omega(k) + \frac{\Delta T K_{mt}}{T_{mt}} u(k) \\ \theta(k) + \Delta T \omega(k) \\ h(k) - \frac{\Delta T(2q_x(k) - q_f(h(k)))}{A(\theta(k))} - \frac{\Delta T h(k)}{A(\theta(k))} \frac{\partial A(\theta(t))}{\partial \theta(t)} \omega(t) - \frac{\Delta T}{A(\theta(k))} \frac{\partial V_s(\theta(k))}{\partial \theta(k)} \omega(k) \\ \left(1 - \frac{2\Delta T}{L_p}\right) q_x(k) + \frac{2\Delta T}{L_p} q_f(h(k)) \\ W(k) + 2\Delta T q_x(k) - \Delta T q_f(h(k)) \\ \left(1 - \frac{\Delta T}{T_{mz}}\right) v_z(k) + \frac{\Delta T K_{mz}}{T_{mz}} u_z(k) \\ x_z(k) + \Delta T v_z(k) \\ \left(1 - \frac{\Delta T}{T_L}\right) W_L(k) + \frac{\Delta T}{T_L}\left(W(k) + \frac{W_a - W(k)}{g}\left(-\frac{1}{T_{mz}} v_z(k) + \frac{K_{mz}}{T_{mz}} u_z(k)\right)\right) \end{pmatrix}$$

$$y(k) = \xi(z(k)) = (\theta(k)\ x_z(k)\ W_L(k))^T \tag{27}$$

where k denotes a sampling number and DT denotes sample time. There is the relationship of t=kDT between k, DT, and time t. Further, the input vector is represented by u(k)=(u(k) uz(k))$^T$. Against Equations (26) and (27), the extended Karman filter is configured as represented by Equations (28) and (29).

$$z_{en}(k+1) = f(z_{ep}(k), v(k)), \tag{28}$$

$$z_{ep}(k) = z_{en}(k) + K(k)(y(k) - \xi(z_{en}(k)) \tag{29}$$

where K(k) denotes Karman gain. Estimated state variables $z_{en}$ and $z_{ep}$ denote a deductive state variable and an inductive state variable. The state estimation is then carried out on Equations (28) and (29) as follows:

Time Update:

$$z_{en}(k+1) = f(z_{ep}(k), v(k)), \tag{30}$$

$$P^n(k+1) = F(k)P_p(k)F^T(k) + Q \tag{31}$$

Linearization:

$$F(k) = \frac{\partial f(z_{ep}(k), v(k))}{\partial z_{ep}(k)} \tag{32}$$

Measurement Update:

$$z_{ep}(k) = z_{en}(k) + K(k)(y(k) - \xi(z_{en}(k)) \tag{33}$$

$$P_p(k) = (I - K(k)C(k))P_n(k) \tag{34}$$

Karman Gain:

$$K(k) = P_n(k)C^T(k)(C(k)P_p(k)C^T(k) + R)^{-1} \tag{35}$$

Linearization:

$$C(k) = \frac{\partial \xi(z_{en}(k))}{\partial z_{en}(k)} \tag{36}$$

where Q and R denote covariance matrix of system noise and observation noise, and P denotes a covariance matrix of an error in a quantity of the estimated state. The processes represented by Equations (30) to (36) are carried out such that the quantity z of state can be estimated. The estimation system for estimating the quantity of state of pouring is executed after the tilting angle that the ladle 3 tilts achieves an angle at which flowing out of the molten metal begins. This angle $q_{sp}$ at which flowing out of the molten metal begins can be estimated as represented by Equation (37) from the weight $_{iq}$ of the molten metal in the ladle 3 that is measured by means of the load cell before flowing out of the molten metal.

$$\theta_{sp} = f_{vs}\left(\frac{W_{lq}}{\rho}\right) \tag{37}$$

where $f_{vs}$ denotes a representation function to represent from the volume $V_s$ of the molten metal beneath the tapping hole of the ladle 3 at the tilting angle q to the tilting angle q. The extended Kalman filter converges an error 0 as the initial error even if Equation (37) involves any estimated error. In the quantity $z_e$ of state that is estimated by means of the extended Kalman filter, the height level $h_e$ of the upper molten metal above the tapping hole of the ladle 3 and the weight $W_e$ of the outflow molten metal are used in the weight-prediction control system for predicting the weight of the outflow molten metal.

EMBODIMENTS

Figure 9:
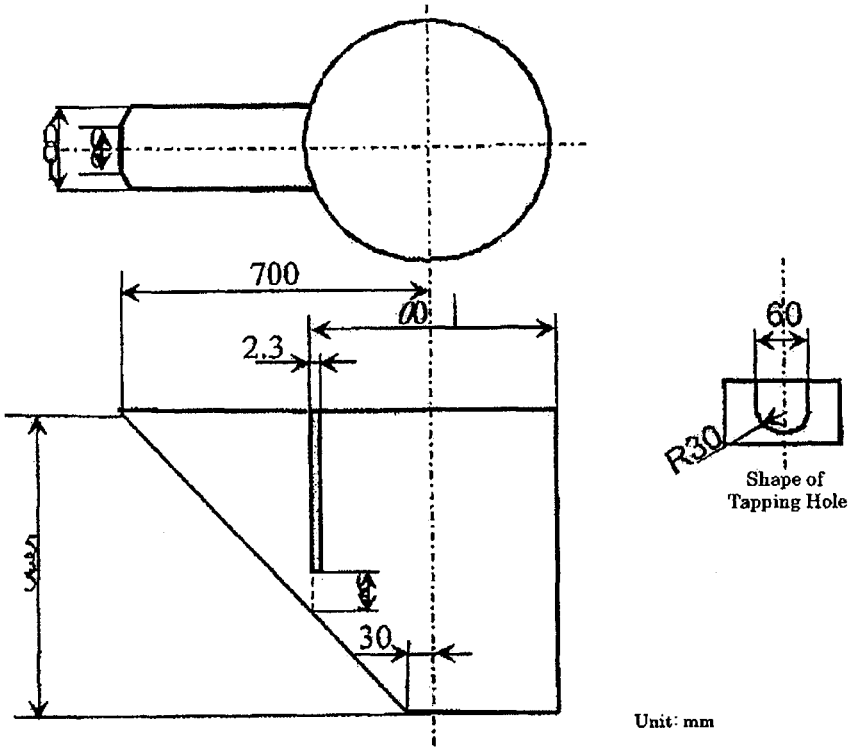
FIG. 9 is a schematic view of a ladle used in experiments to illustrate an inner shape thereof and a shape of its tapping hole.

FIG. 9 illustrates the inner shape of the ladle used in experiments and the shape of its tapping hole. Based on the shape of the ladle 3 of FIG. 9, at the tilting angle q, the volume $V_s$ of the molten metal beneath the tapping hole of the ladle 3 and the area A of the surface of the molten metal can be derived as the results shown in FIG. 10. The relationship between the volume of the molten metal beneath the tapping hole of the ladle and the area of the surface of the molten metal as shown in FIG. 10 may be obtained using a numerical integral or CAD software.

Figure 10:
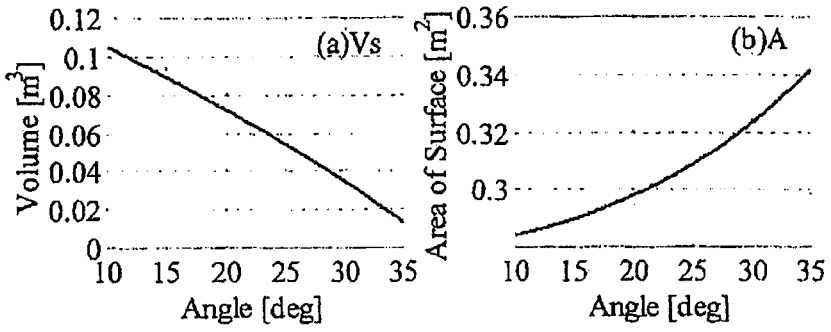
FIG. 10 shows graphic charts plotting relationships between the tilting angle of the ladle denoted in FIG. 9 and the volume of the molten metal in the lower portion of the tapping hale of the ladle, and an area of surface thereof.
Figure 11:
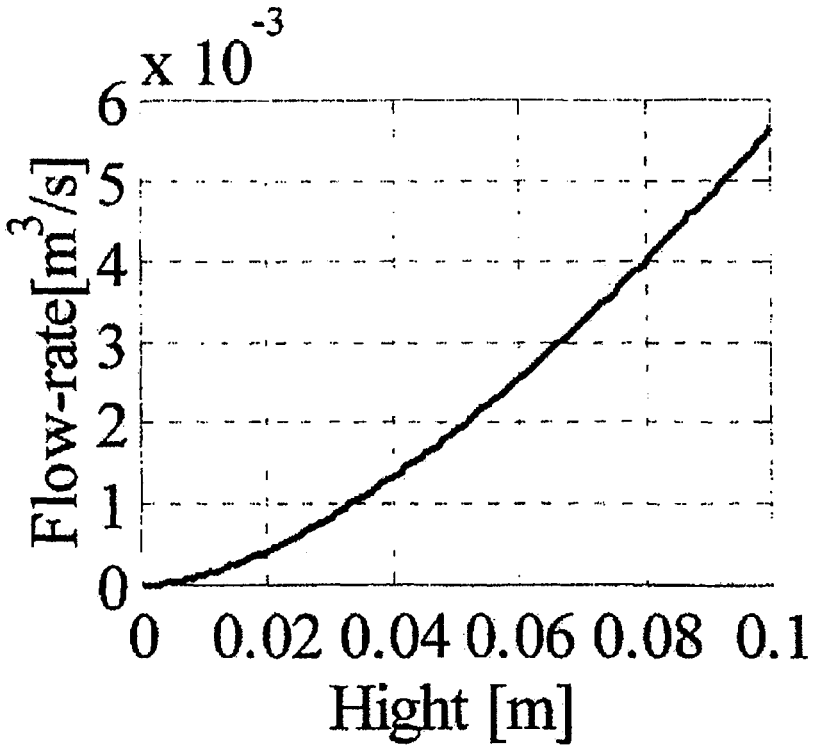
FIG. 11 is a graphic chart plotting the relationship between the height (h) of the molten metal at the tapping hole of the ladle illustrated in FIG. 9 and a flow rate ($q_f$) of the molten metal, where a coefficient of the flow rate is assumed to be 1.

$f_{vs}$ in Equation (37) denotes an inverse mapping of the relationship as shown in FIG. 10(*a*) between the tilting angle q that the ladle tilts and the volume $V_s$ of the molten metal beneath the tapping hole of the ladle. Further, FIG. 11 shows the relationship between the height h of the molten metal at the tapping hole of the ladle and the flow rate $q_f$ of the molten metal poured when the flow rate coefficient is 1. The relationship as shown in FIG. 11 may be derived from Equation (5). Based on identification experiments, assuming that the flow rate coefficient c is c=0.64, the delay $L_p$ in response of the molten metal to flow from the ladle due to surface tension effect is $L_p$=0.45 [s], and the density r is r=103 [Kg/m$^3$]. These parameters are provided to the model of the automatic pouring process.

Based on identification experiments, assuming that the time constant $T_{mt}$ and the gain constant $K_{mt}$ of the motor for tilting the ladle are $T_{mt}$=0.01 [s] and $K_{mt}$=1.0 [deg/sV], and the time constant $T_{mz}$ and the gain constant $K_{mz}$ of the motor for vertically moving the ladle are $T_{mz}$=0.01 [s] and $K_{mz}$=1.0 [m/sV]. They are provided to the respective models of the motors. Further, based on identification experiments, assuming that the time constant $T_L$ of the load cell is $T_L$=0.159 [s].

Figure 12:
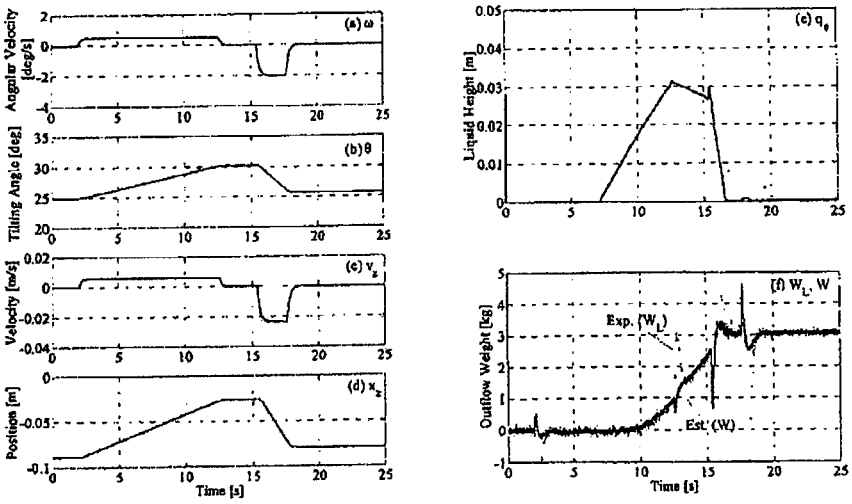
FIG. 12 shows graphic charts plotting the result of experiments that have been carried out using water in place of the molten metal.

FIG. 12 shows the results of experiments that were carried out using water in place of the intended molten metal. The pouring motion is carried out with the forward-tilting angular velocity is 0.5 [deg/s] and the inverse-tilting angular velocity is 2.0 [deg/s]. The target weight of the outflow alternative water is 3.0 [Kg] and the weight of the outflow water when the forward-tilting motion of the ladle is suspended is 1.0 [Kg].

In FIG. 12, (a) shows tilting angular velocities that are predicted by means of the extended Kalman filter, (b) shows tilting angles, (c) shows velocities of the vertical motion of the ladle, (d) shows positions of the ladle in the vertical motion, (e) shows liquid heights above the tapping hole, and (f) shows outflow weights of the liquid. In FIG. 12(*f*), the narrow line denotes the measured outflow weights of the liquid that are measured by means of the load cell, while the heavy line denotes the predicted outflow weights of the liquid. The fact that the quantities of state of the liquid can be predicted by means of the extended Kalman filter is confirmed by these results. In FIG. 12(*f*), on the measured outflow weights of the liquid, the effects of the noise and the effects of the vertical motion of the ladle, and the dynamic characteristics of the load cell are superimposed, and thus it is difficult to actually measure the outflow weights of the liquid. In contrast, the fact that regarding the predicted weight of the outflow liquid, the effects of the noise and the vertical motion of the ladle are reduced and the delay in response due to the dynamic characteristics of the load cell is compensated is confirmed by the above results. Because the control for predicting the outflow weight of the liquid is carried out based on the predicted quantities of state of pouring, it is understand that an accurate pouring can be achieved in which the actual outflow weight of the liquid is 3.05 [Kg] to the target outflow weight of the liquid is 3.0 [Kg].

Figure 13:
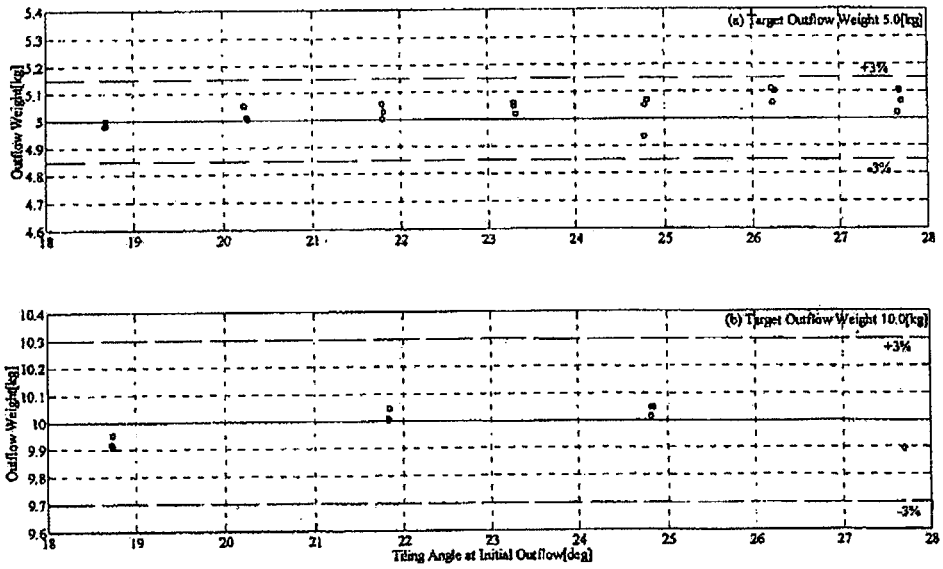
FIG. 13 shows graphic charts plotting outflow weights of the water in water-pouring experiments that have been carried out with various initial angles of a ladle at the beginning of the outflow of the water.

The pouring conditions such as the target outflow weight of the liquid and the tilting angle at which the outflow of the liquid begins were varied to determine if the accuracy of pouring is maintained. FIGS. 13(*a*) and (*b*) show the outflow weights of the liquid in the experiment in which different tilting angles at which the outflow of the liquid begins are used with the target outflow weights of the liquid were 5 [Kg] (FIG. 13(*a*)) and 10.0 [Kg] (FIG. 13(*b*)). In FIGS. 13(*a*) and (*b*), the broken lines denote an area in which an error is in the range of ±3[%] against the target outflow weights of the liquid, while the plotted circlets denote the outflow weight of the liquid that was obtained through experiments. The extent of the error was about 0.1 [Kg] against the target outflow weight of the liquid even if the different target outflow weights of the liquid and the different tilting angle at which outflow of the liquid began were used. Therefore, accurate pouring can be achieved in the different pouring conditions.

Nevertheless, it will be understood that various modifications may be made without departing from the spirit and scope of the invention. For example, some of the steps described herein may be order-independent, and thus can be performed in an order different from that described.

The invention claimed is:

1. A method for tilting-type automatic pouring of molten metal from a ladle to a mold, wherein the ladle has a tapping hole having a predetermined shape and holds the molten metal, by tilting the ladle by means of a servo motor under the control of a computer in which a program to execute a pouring process is pre-configured, the method comprising the steps of:

measuring outflow weight of the molten metal that flows from the ladle;

measuring the tilting angle that the ladle tilts and the moving position of the ladle along the direction of vertical motion of the ladle;

estimating the height level of the molten metal above the tapping hole of the ladle and the outflow weight of the molten metal that flows from the ladle, using an extended Kalman filter, based on the measured outflow weight of the molten metal that flows from the ladle, the measured tilting angle that the ladle tilts, the measured position of the ladle along a direction of vertical motions of the ladle, and an input voltage to the servo motor;

predicting the final outflow weight of the molten metal as the sum of a predicted outflow weight of the molten metal that flows from the ladle when the ladle inversely tilts, which is predicted based on the tilting angle of the ladle and the estimated height level of the molten metal above the tapping hole of the ladle that has been estimated by the extended Kalman filter, and the estimated outflow weight of the molten metal that flows from the ladle and that has been estimated by the extended Kalman filter; and determining if the predicted final outflow weight of the molten metal is at least a specified outflow weight, and beginning an inverse tilting motion of the ladle based on the determined result.

2. The method of claim 1, further comprising the step of forward and rearward movement and vertical movement of the ladle in synchronization with the tilting motion of the ladle such that the tapping hole is positioned at the center of the tilting motion of the ladle.

3. A tilting control system for automatic pouring of molten metal from a ladle to a mold, wherein the ladle has a tapping hole having a predetermined shape and holds the molten metal, by tilting the ladle by means of a servo motor under the control of a computer in which a program to execute a pouring process is pre-configured, the system comprising:

a storage means for storing a model of a flow rate of the molten metal poured that flows from the ladle to a mold;

a controlling means for controlling the forward and rearward movement and vertical movement of the ladle in synchronization with a tilting motion of the ladle such that a tapping hole of the ladle is positioned on the center of the tilting motion of the ladle;

a weight-measuring means for measuring the weight of the molten metal in the ladle before a pouring motion begins;

a detecting means for detecting the tilting angle that the ladle tilts and the moving position of the ladle in its vertical motions;

an angular-deriving means for deriving a tilting angle that the ladle tilts to begin the flow of the molten metal from the ladle by converting the measured weight of the molten metal in the ladle that has been measured by the weight-measuring means;

an estimating means for operatively estimating the height level of the molten metal above the tapping hole of the ladle and an outflow weight of the molten metal that outflows from the ladle, using an extended Kalman filter, based on an outflow weight of the molten metal that outflows from the ladle that corresponds to the measured weight of the molten metal in the ladle, the measured tilting angle that the ladle tilts, the measured moving position of the ladle in its vertical motions, and an input voltage to the servo motor;

a first weight-calculating means for calculating the weight of the molten metal that flows from the ladle after beginning an inverse tilting motion of the ladle;

a second weight-calculating means for converting the measured weight of the molten metal in the ladle to an outflow weight of the molten metal that flows from the ladle into a mold;

a third weight-calculating means for calculating the final outflow weight of the molten metal from the forward tilting motion of the ladle to the inverse tilting motion of the ladle as the sum of an outflow weight of the molten metal that flows from the ladle when the inverse tilting motion of the ladle begins and an outflow weight of the molten metal that outflows from the ladle after the inverse tilting motion of the ladle begins; and a determining means for determining if the calculated final outflow weight of the molten metal is at least a specified outflow weight, and for beginning an inverse tilting motion of the ladle based on the determined result.

4. A non-transitory computer-readable storage medium storing a tilting control program to cause a computer to execute an automatic pouring of molten metal from a ladle to a mold, wherein the ladle has a tapping hole having a predetermined shape and holds the molten metal, by tilting the ladle by means of a servo motor under a control of the computer in which a program to execute a pouring process is pre-configured, the tilting control program comprising the steps of:

estimating the height level of the molten metal above the tapping hole of the ladle and an outflow weight of the molten metal that outflows from the ladle, using an extended Kalman filter, based on measured outflow weight of the molten metal that outflows from the ladle, a measured tilting angle that the ladle tilts, a measured position of the ladle along a direction of vertical motion of the ladle, and an input voltage to the servo motor;

predicting the final outflow weight of the molten metal as the sum of a predicted outflow weight of the molten metal that flows from the ladle when the ladle inversely tilts, which is predicted based on the tilting angle of the ladle and the estimated height level of the molten metal above the tapping hole of the ladle that has been estimated by the extended Kalman filter, and the estimated outflow weight of the molten metal that outflows from the ladle and that has been estimated by the extended Kalman filter; and determining if the predicted final outflow weight of the molten metal is at least a specified outflow weight, and beginning an inverse tilting motion of the ladle based on the determined result.

5. The non-transitory computer-readable storage medium of claim 4, wherein the measured outflow weight of the molten metal is measured by means of a load cell.

6. The non-transitory computer-readable storage medium of claim 4, wherein the tilting angle that the ladle tilts and the moving position of the ladle in its vertical motions are measured by means of respective rotary encoders that are mounted on the servo motor.

* * * * *